US008506023B2

(12) United States Patent
Goldie

(10) Patent No.: US 8,506,023 B2
(45) Date of Patent: Aug. 13, 2013

(54) HANDGUN SAFE

(75) Inventor: Scott Dennis Goldie, Littleton, CO (US)

(73) Assignee: QuickDrawer LLC, Littleton, CO (US)

( * ) Notice: Subject to any disclaimer, the term of this patent is extended or adjusted under 35 U.S.C. 154(b) by 261 days.

(21) Appl. No.: 13/053,588

(22) Filed: Mar. 22, 2011

(65) Prior Publication Data

US 2011/0233085 A1 Sep. 29, 2011

Related U.S. Application Data

(60) Provisional application No. 61/318,152, filed on Mar. 26, 2010.

(51) Int. Cl.
*A47B 97/00* (2006.01)

(52) U.S. Cl.
USPC ..... 312/204; 312/270.3; 312/291; 312/301

(58) Field of Classification Search
USPC ..... 312/204, 270.1, 270.3, 291, 301, 312/333; 206/317
See application file for complete search history.

(56) References Cited

U.S. PATENT DOCUMENTS

| | | | | | |
|---|---|---|---|---|---|
| 128,439 | A | * | 6/1872 | Unna | 312/204 |
| 1,147,998 | A | * | 7/1915 | Anderson | 312/204 |
| 3,236,172 | A | * | 2/1966 | Haedike et al. | 99/413 |
| 3,278,248 | A | * | 10/1966 | Torok | 312/308 |
| 3,528,718 | A | * | 9/1970 | Manfred et al. | 312/308 |
| 3,826,552 | A | * | 7/1974 | Anderson | 312/409 |
| 4,156,549 | A | * | 5/1979 | Clark | 312/270.3 |
| RE32,456 | E | * | 7/1987 | Ishii | 200/61.61 |
| 4,786,785 | A | * | 11/1988 | Felt | 235/7 R |
| 4,800,822 | A | | 1/1989 | Adkins | |
| 4,869,449 | A | * | 9/1989 | Goodman | 248/205.1 |
| 5,044,059 | A | * | 9/1991 | De Giulio | 29/401.1 |
| 5,056,342 | A | | 10/1991 | Prinz | |
| 5,118,175 | A | * | 6/1992 | Costello | 312/242 |
| 5,168,994 | A | * | 12/1992 | Beletsky et al. | 206/317 |
| 5,222,789 | A | * | 6/1993 | Yoshikawa | 312/270.3 |
| 5,317,888 | A | * | 6/1994 | Towns | 70/63 |
| 5,380,990 | A | * | 1/1995 | Baitz et al. | 235/7 R |
| 5,579,909 | A | * | 12/1996 | Deal | 206/317 |
| 5,701,770 | A | * | 12/1997 | Cook et al. | 70/63 |
| 5,713,650 | A | | 2/1998 | King et al. | |
| 5,838,626 | A | | 11/1998 | Nakayama | |
| 5,944,396 | A | * | 8/1999 | Stephan | 312/204 |
| 6,260,300 | B1 | * | 7/2001 | Klebes et al. | 42/70.11 |
| 6,525,298 | B1 | * | 2/2003 | Hunts | 219/400 |
| 6,811,232 | B2 | * | 11/2004 | Doan et al. | 312/291 |
| 7,261,385 | B2 | * | 8/2007 | Weinberger | 312/330.1 |
| 8,157,338 | B2 | * | 4/2012 | Seo et al. | 312/402 |
| 8,186,188 | B1 | * | 5/2012 | Brown | 70/63 |
| 2002/0124779 | A1 | * | 9/2002 | Perkins | 109/47 |
| 2007/0046423 | A1 | * | 3/2007 | Baucom | 340/5.5 |
| 2008/0236452 | A1 | | 10/2008 | Pratt et al. | |
| 2009/0165682 | A1 | | 7/2009 | Cleveland et al. | |

* cited by examiner

*Primary Examiner* — Hanh V Tran
(74) *Attorney, Agent, or Firm* — Swanson & Bratschun, LLC

(57) ABSTRACT

A handgun safe including a tray to receive a handgun and a lid operatively associated with the tray such that the tray may slide horizontally with respect to the lid to selectively reveal or conceal the interior portion of the tray. In all embodiments the height of the lid is less than the height of the tray. The handgun safe may further include a latch associated with the lid and tray configured to secure or lock the tray in a closed position with respect to the lid. The handgun safe may further include an electronic switch configured to cause the latch to disengage. The electronic switch may include a biometric scanner, electronic lock or other security device.

10 Claims, 4 Drawing Sheets

HANDGUN SAFE

This application claims the benefit under 35 USC section 119 of U.S. provisional application 61/318,152 filed on Mar. 26, 2010 and entitled "Handgun Safe," the content of which is hereby incorporated by reference in its entirety and for all purposes.

BACKGROUND

Many persons desire to maintain a handgun in their home for personal defense. A handgun however is a dangerous item in the possession of an unauthorized user. For example, it is essential that a properly stored handgun not be accessible to a small child, an intruder or another unauthorized user. Accordingly, handguns are often stored in locked enclosures generally referred to as handgun safes or gun safes.

A handgun must be immediately accessible, if the handgun is to properly fulfill the role of personal or home defense. For example, if a homeowner awakens in the middle of the night and realizes that an intruder is present in his or her home, it is critical that the homeowner be able to immediately access his defensive weapon. The requirement of easy and immediate access to a handgun, even in the dark, substantially contradicts the requirement that the handgun be safely and securely stored away from unauthorized users. In particular, conventional handgun safes with complicated touch pad locks, keys or other security devices may be difficult or impossible to open quickly and efficiently in an emergency. Furthermore, a conventional handgun safe may be unobtrusively stored in an out of the way closet or other relatively remote storage area, thus enhancing the possibility that an intruder will place himself between the handgun owner and his or her defensive weapon, defeating the purpose of owning a gun for home defense.

A conventional handgun safe is strictly utilitarian. The safe or lockbox is not an attractive item if it is placed on a nightstand near the owner's bed for example. Furthermore, a gun safe stored in the open may attract the attention of children, intruders, thieves or other unauthorized persons. The embodiments disclose herein are directed toward overcoming one or more of the problems identified above.

SUMMARY OF THE EMBODIMENTS

One embodiment includes a handgun safe including a tray to receive a handgun and a lid operatively associated with the tray such that the tray may slide horizontally with respect to the lid to selectively reveal or conceal the interior portion of the tray. In all embodiments the height of the lid is less than the height of the tray. For example, the height of the lid may be equal to or less than 1, ¾, ½ or ⅜ inch.

The handgun safe may further include a latch associated with the lid and tray configured to secure or lock the tray in a closed position with respect to the lid. The latch may be a dynamically adjustable latch configured to secure the tray in one or more positions with respect to the lid.

The handgun safe may further include an electronic switch configured to cause the latch to disengage. In one embodiment, the electronic switch may be configured to send a command to a logic circuit or microprocessor associated with the handgun safe which causes the latch to disengage. The electronic switch may include a biometric scanner, electronic lock or other security device.

The handgun safe may also include means for forcing the tray to move horizontally with respect to the lid upon disengagement of the latch. Horizontal movement of the tray may be caused by a combination of springs of any type, other mechanical devices or electromechanical devices, for example one or more solenoids, actuators, motors or drive screws.

An alternative embodiment is a handgun safe as described above associated with an article of furniture. The article of furniture will include a sliding drawer and a frame. A representative, but non-exclusive article of furniture would be a bedside nightstand having one or more sliding drawers. The handgun safe may be installed as an upgrade to a previously owned article of furniture provided the furniture drawer is sized appropriately to receive the safe. The various embodiments of handgun safe as described herein may be installed in an article of furniture with minimal modification to the furniture.

The handgun safe may be installed in an article of furniture by attaching the lid to a portion of the furniture frame, for example the interior underside of the top structure of a nightstand. In addition the tray may optionally be attached to the furniture drawer. Alternatively a dedicated mounting bracket may be provided to facilitate installation of the handgun safe in an operative position. In all configurations the combined height of the lid of the handgun safe plus any optional bracket will be less than a gap between the back plate of the furniture drawer and adjacent portions of the frame. Thus, when the handgun safe tray and furniture drawer slide horizontally into an open position, the back plate of the furniture drawer will have clearance underneath the stationary lid and optional bracket.

Also disclosed is a method of operating a handgun safe and a method of storing a handgun. As described above, the handgun safe may be operatively concealed within a conventional article of furniture without substantially modifying the furniture. In use, an electronic switch associated with the handgun safe can trigger the automatic horizontal movement of the handgun safe with respect to the lid. Since the tray is positioned within a furniture drawer and the lid is attached to the furniture frame and furthermore since the height of the lid and any optional mounting bracket is sufficiently limited to pass through the gap between the back of the drawer and the furniture face frame, the handgun safe tray and the drawer will be opened together, automatically, upon activation of the switch. In an alternative embodiment the mounting bracket may be configured to provide for the limited manual opening of the furniture drawer providing unpowered access to a manual lock associated with the lid.

The apparatus and methods disclosed herein provide a secure and completely concealed handgun safe which may be installed in a conventional article of furniture. Furthermore, the contents of the handgun safe may be accessed quickly in the event of an emergency.

DETAILED DESCRIPTION

Figure 1:
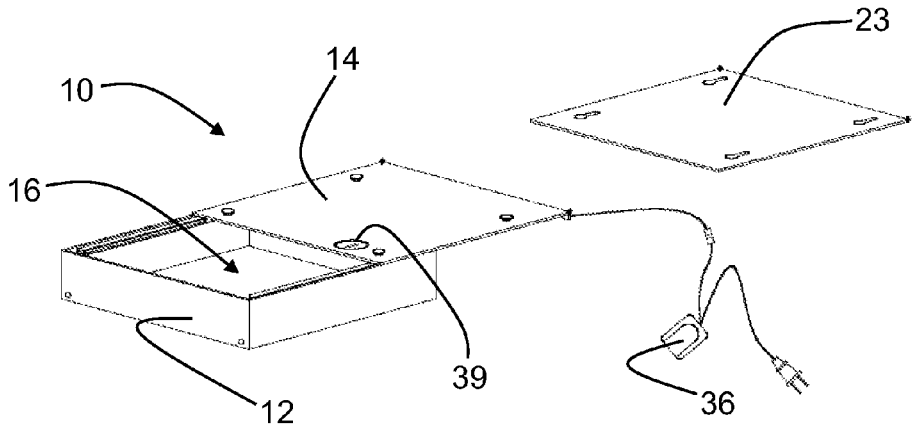
FIG. 1 is perspective view of a handgun safe and optional mounting bracket.
Figure 2:
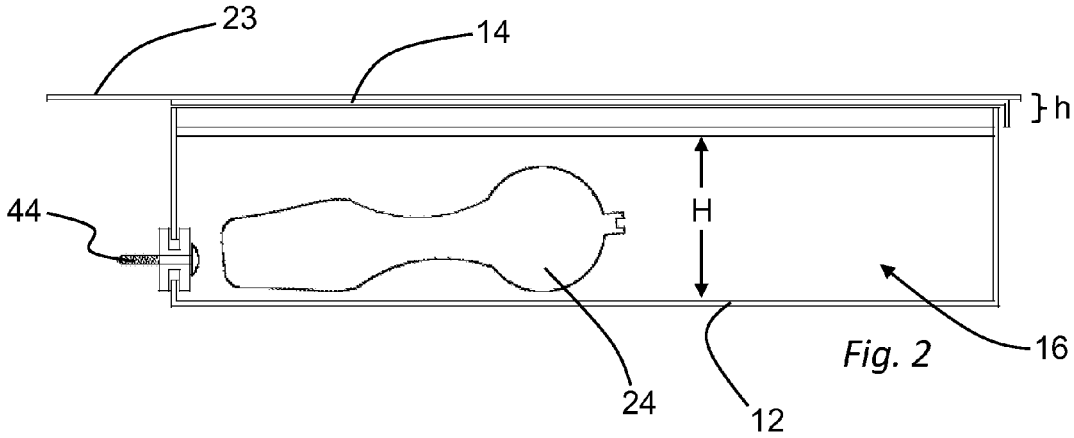
FIG. 2 is a cross sectional side elevation view of the handgun safe of FIG. 1 in a closed position.
Figure 3:
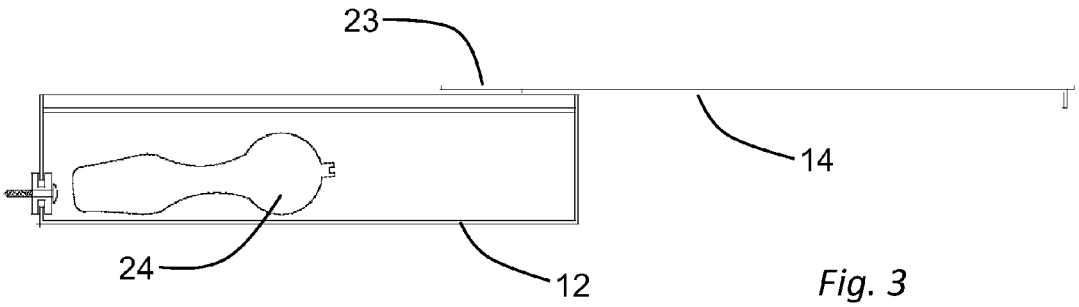
FIG. 3 is a cross sectional side elevation view of the handgun safe of FIG. 1 in a open position.

One embodiment disclosed herein is a handgun safe 10 which includes a tray 12 and lid 14. As shown in FIG. 1, the lid 14 is operatively associated with the tray 12 such that the tray 12 may slide horizontally with respect to the lid 14 thereby selectively revealing or concealing an interior portion 16 of the tray 12. Thus, the tray 12 may slide with respect to the lid 14 into a substantially open position as shown in FIG. 1 and FIG. 3 or a substantially closed position as shown in FIG. 2 where the lid 14 covers the interior portion 16 of the tray 12.

Figure 4:
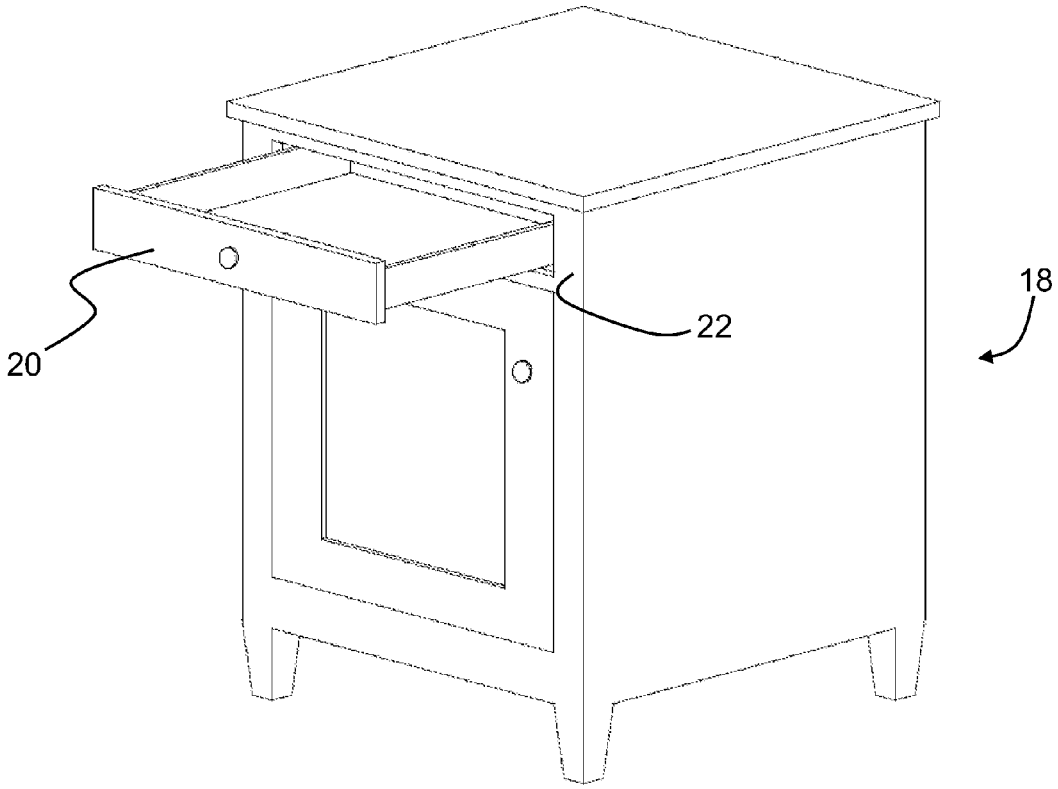
FIG. 4 is a perspective view of an article of furniture suitable for the installation of a handgun safe.

The handgun safe 10 is configured to be concealed within an article of furniture having a sliding drawer. As shown in FIG. 4, a representative, but non-exclusive, article of furniture 18 suitable for concealing the handgun safe 10 is a nightstand, which includes a sliding drawer 20 and a frame 22. As used herein, the frame 22 is defined to include all of the structure of the article of furniture 18 but for the drawer 20. As shown on FIG. 4, the article of furniture 18 may include other parts such as a top, sides, legs, doors, etc. These other parts are collectively referred to as the frame 22 herein.

Mounting of the handgun safe 10 to an article of furniture 18 may be accomplished by mounting the lid 14 directly to the furniture frame 22. Alternatively, a more flexible mounting arrangement may be accomplished by mounting a bracket 23 (FIG. 1) to the article of furniture frame 22 and attaching the lid 14 to the bracket 23.

Figure 5A:
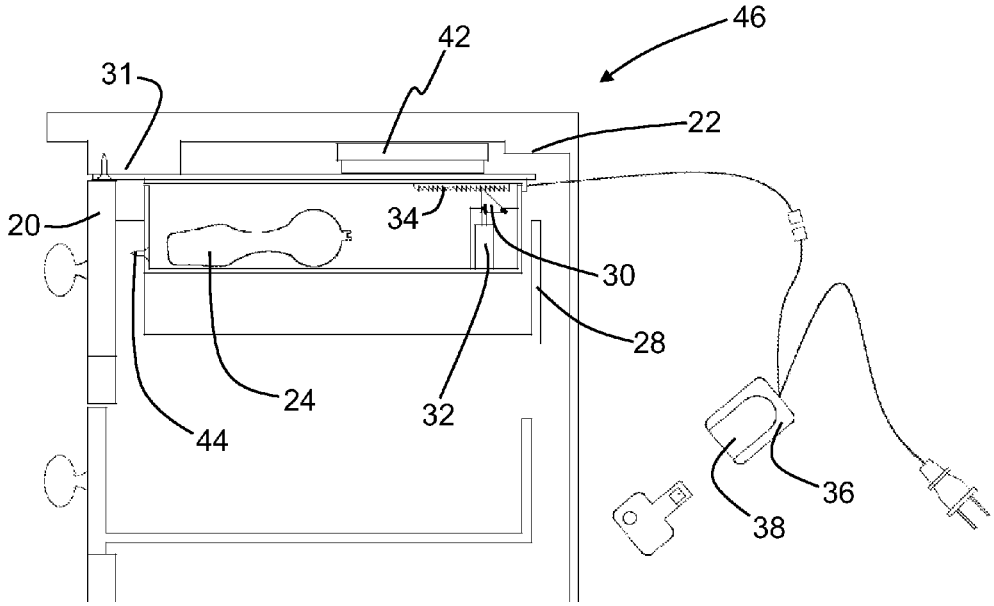
FIG. 5A is a side cross sectional view of the handgun safe in a closed position, installed in an article of furniture.
Figure 5B:
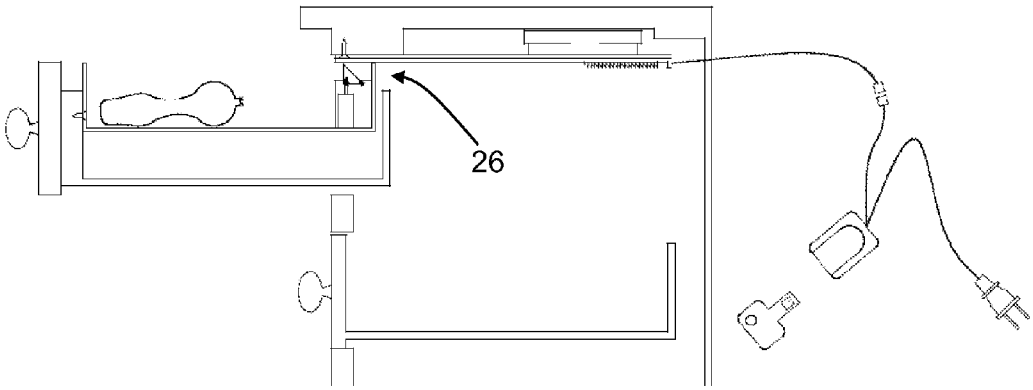
FIG. 5B is a side cross sectional view of the handgun safe in an open position, installed in an article of furniture.

As is best shown in FIGS. 5A and 5B, the handgun safe 10 is sized to be small enough to fit within the drawer 20 of the article of furniture 18 but sized large enough to receive a handgun 24 within the interior portion 16 of the tray 12. It may also be noted from FIG. 2 and FIG. 3 that the lid 14 must have an overall vertical height (h) which is less than the overall vertical height (H) of the tray 12. In some embodiments the height of the lid 14 is equal to or less than 1 inch. In other embodiments the height of the lid 14 is equal to or less than ¾ inch. In other embodiments the height of the lid 14 is equal to or less than ½ inch. In other embodiments the height of the lid 14 is equal to or less than ⅜ inch. Other lid heights may be selected as desired provided the functionality described in detail below is preserved. In particular, the height of the lid 14 plus the height of any optional associated mounting bracket 23 must be selected to be less than a gap 26 between the back plate 28 of the drawer 20 and any portion of the frame 22 that may become positioned immediately above the top surface of the back plate 28 as the drawer travels horizontally.

Figure 6:
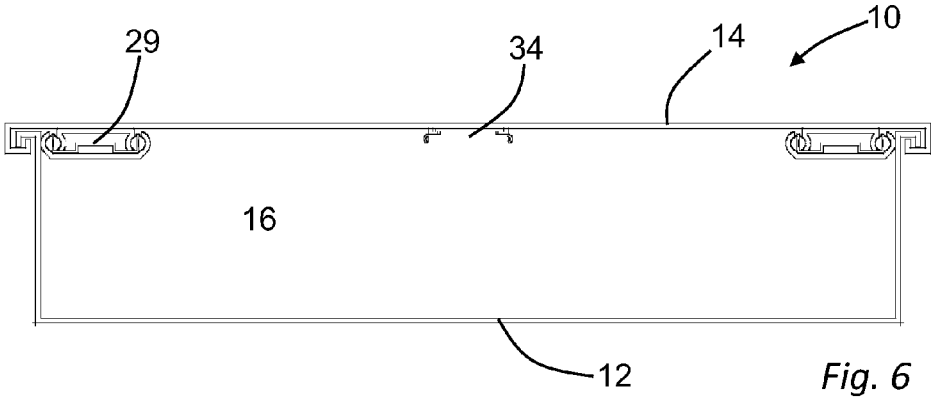
FIG. 6 is a cross sectional front elevation view of the handgun safe of FIG. 1

FIG. 6. is a cross sectional front elevation view of the handgun safe 10 of FIGS. 1-3. As shown in FIG. 6, the lid 14 and tray may have robust interlocking elements to assure that the tray cannot easily be pried from the lid, thus providing additional security. In addition, linear bearings 29 or another suitable bearing surface which assures that the tray 12 will slide open with respect to the lid 14 may be located within the interior portion 16 of the handgun safe 10 to minimize the possibility of tampering and unauthorized access.

As described above, any portion of the frame 22 immediately above the top surface of the back plate 28 defines a gap 26. In the embodiment illustrated in FIGS. 5A and 5B, this relevant structure is the interior underside of the top of the article of furniture 18 or the front face frame 31 of the article of furniture, depending upon how the furniture is constructed. In the FIGS. 5A and 5B representation for example, the front face frame 31 defines the gap 26. In alternative embodiments, for example where the handgun safe 10 is positioned within a middle or lower drawer, the gap 26 may be defined by the bottom of an upper drawer, an interior frame member or other structure.

It is necessary that the height of the lid 14 and any optional bracket 23 be less than the gap 26 if undue modification of the article of furniture 18 is to be avoided. In use the drawer 20, tray 12 and back plate 28 are each structures which must slide outward to expose the interior portion 16 of the tray 12 providing access to a handgun 24. The lid 14, however, remains affixed to the frame 22 of the article of furniture 18. Thus the back plate 28 must slide underneath the lid 14. This cannot occur without permanent modification of the back plate 28 if the height of the lid and any associated bracket 23 is greater than the height of the gap 26.

As is also shown in FIG. 5, the handgun safe 10 may include a latch 30 which may be an electronically articulated latch. For example, the latch 30 may be articulated by a solenoid 32, and actuator, motor or similar electromechanical device. The latch 30 serves to secure the tray 12 into a closed position with respect to the lid 14. In selected embodiments the latch 30 will be a dynamically adjustable latch. For example, as the tray 12 is closed, the latch 30 may engage with the successive pawls of a lengthwise ratchet 34 which allows the tray 12 to be secured with respect to the lid 14 at more than one selectable horizontal closed position.

The handgun safe 10 may also include a switch 36 in electronic or mechanical communication with the latch 30. The switch 36 is configured to cause the latch to disengage.

Additional security may be realized if the handgun safe 10 includes an internal logic circuit, processor, small computer or similar device which is physically located within the interior portion 16 of the tray 12 and which logic circuit directly controls the latch 30. In an embodiment with onboard computing functionality, the switch 36 may merely send a command to disengage the latch to the logic circuit or microprocessor located within the handgun safe 10. The logic circuit may cause the command to be executed upon proper authentication. This functionality provides additional security by preventing an unauthorized user from disengaging the latch 30 through a simple electronic "hot wire" modification to the switch 36.

The switch 36 may further provide additional security by incorporating a biometric scanner. For example the switch 36 may include a fingerprint reader 38 or other biometric device which is programmed in conjunction with the internal logic circuit or microprocessor to verify the identity of an authorized used before a disengage command is sent to the latch.

A digital or mechanical combination lock or similar device may be used with or in addition to the biometric device to prevent unauthorized access to the handgun safe 10. Similarly, a separate key, which corresponds to a supplemental lock 39, whether mechanical or electronic may be associated with the handgun safe 10 and/or switch 36 to provide supplemental security. Supplemental security devices other than a biometric device such as the fingerprint reader 38 will possibly delay the process of opening the handgun safe 10. Delay could be disadvantageous in an emergency situation.

Further fail-safe security functionality may be provided by including a rechargeable battery backup power supply in or near the handgun safe 10. The backup power supply would assure that a fully authorized user could access the contents of the handgun safe 10 in an emergency, even if household current had been interrupted, or the regular power supply had been disconnected by an intruder. Alternatively, the bracket 23 or other attachment between the lid 14 and the article of furniture 18 may provide for a partial manual opening of the drawer for access to the supplemental lock 39. Thus, in embodiments where backup power is not supplied or the backup power and primary power supplies both fail, the gun owner could access the gun by pulling the drawer 20 out just enough to access the supplemental lock, unlocking the supplemental lock and then completing the opening procedure.

Figure 7A:
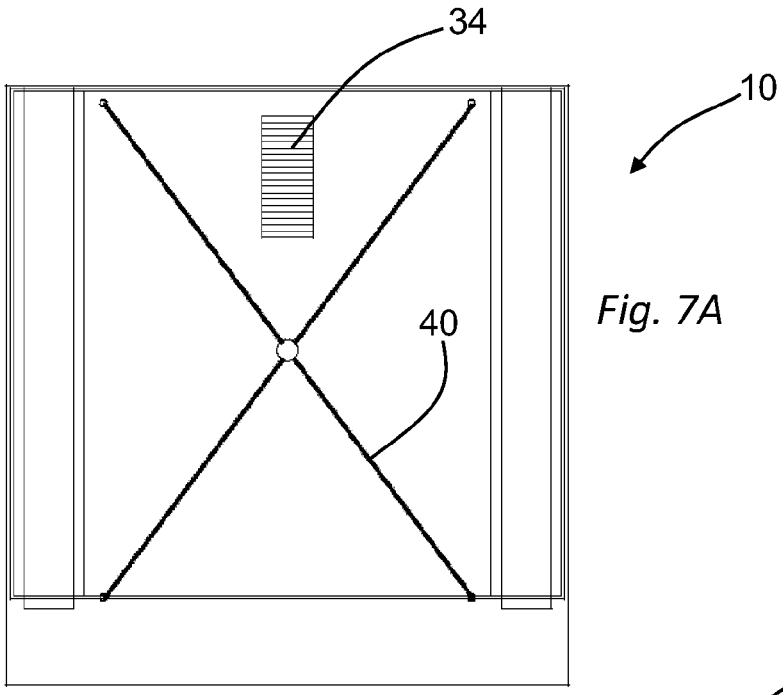
FIG. 7A is a cross sectional top plan view of the handgun safe of FIG. 1 in a closed position.
Figure 7B:
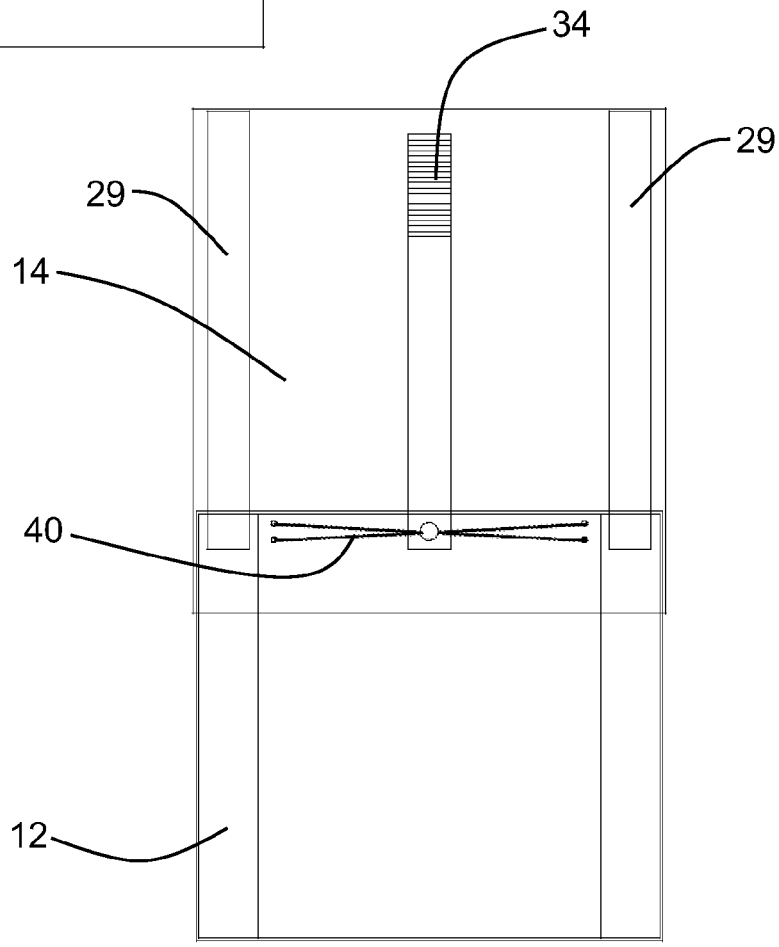
FIG. 7B is a cross sectional top plan view of the handgun safe of FIG. 1 in an open position.

The handgun safe 10 may also include means to automatically cause the tray 12 to move horizontally into the open position upon disengagement of the latch 30. The means to move the tray 12 with respect to the lid 14 can be implemented with a simple mechanical device such as the springs 40 as shown in FIGS. 7A and 7B. The springs 40 are placed under tension when the tray is placed in a closed position with respect to the lid 14, as shown in the view of FIG. 7A. Upon disengagement of the latch 30, the springs 40 can freely contract, forcing the tray 12 into the horizontally extended open position of FIG. 7B. Other mechanical devices such as pneumatic or hydraulic cylinders, coiled springs, compression springs or similar apparatus could be implemented as a means to automatically force the tray open with respect to the lid 14. Similarly, commonly available electromechanical devices such as one or more solenoids, actuators, motor and pulley, chain or belt drive systems, screw drives and the like could be implemented as a means to automatically cause the tray 12 to move horizontally with respect to the lid 14 upon disengagement of the latch 30.

The crossed tension springs 40 shown in FIGS. 7A and 7B are advantageous as placement in this configuration will allow the springs 40 to remain clear of the latch 30 when the tray 12 is placed into the closed position and further allow the springs 40 to collapse into a relatively narrow space when the tray 12 is automatically moved into the open position of FIG. 7B.

In certain embodiments, a spacer 42 (see FIG. 5A-5B) may be necessary to properly position the handgun safe within an article of furniture 18. The spacer may be connected to the top or outer portion of the lid 14 opposite the tray 12 and also connected to the frame 22 of the furniture 18. Thus, as shown in FIG. 5 the spacer 42 serves to properly center the lid 14 within the gap 26 without unduly modifying the furniture 18. As also shown in FIG. 5 the tray may optionally be attached to the drawer 20, for example with one or more screws 44.

An alternative embodiment is a handgun safe system 46 which includes the handgun safe 10 as described above mounted within an article of furniture 18. As shown in FIGS. 5A-5B, the lid 14 and optional bracket 23 may be affixed to the frame 22 of the article of furniture 18 with one or more screws, bolts or similar fasteners. It may be necessary to use a spacer 42 to properly position the lid 14 with respect to the drawer 20 and gap 26. In addition, the tray 12 may optionally be attached to an inner surface of the drawer 20.

With the tray 12 positioned within or attached to the drawer 20 and the lid 14 attached to the frame 22, horizontal motion of the tray 12 with respect to the lid 14 will also cause the drawer 20 to move open with respect to the article of furniture 18.

Since the lid 14 has a relatively short height (h) the handgun safe 10 is configured to be installed in any exiting article of furniture 18 which has a sliding drawer 20. Most drawers in typical furniture have a gap 26 between the upper portion of a drawer back plate 28 and the adjacent furniture frame 22. Thus, the handgun safe 10 is conveniently adaptable to existing furniture where the handgun safe 10. When installed within an article of furniture 18, the handgun safe 10 conceals the presence of a handgun providing additional security since small children and intruders have no reason to believe that a handgun is placed within an unobtrusive furniture drawer. Furthermore, the mounting convenience provided by the apparatus described above facilitates the placement of a handgun safe in an existing article of furniture that fully matches the balance of the furniture in a room, further concealing the presence of the handgun safe and handgun.

Embodiments including a switch 36 and latch 30 mechanisms as described may only be easily opened by an authorized user. Accordingly, another embodiment is a method of operating a handgun safe 10 or a method of storing a concealed handgun. The method includes providing a handgun safe 10 as described above, installed within the drawer 20 of an article of furniture 18. The lid 14 of the handgun safe 10 is mounted to the frame 22 of the furniture 18 and the tray 12 of the handgun safe 10 is optionally mounted to the drawer 20 of the article of furniture 18. When thus configured, an authorized user may program logic associated with the latch 30 and switch 36 such that he or other authorized users are the only persons who may properly open the handgun safe 10. After programming the system, the operator may place a handgun or similar item which requires extreme security into the handgun safe 10 and close the furniture drawer 20. Closing the furniture drawer will simultaneously close the handgun safe tray 12 with respect to the handgun safe lid 14. If the handgun safe 10 is provided with a dynamically adjustable latch 30 as shown in FIG. 5, as the operator closes the drawer 20 the latch 30 engages with the lengthwise ratchet 34 and subsequently locks the tray 12 with respect to the lid 14 at the location where the drawer 20 is properly and completely closed with respect to the furniture frame 22. The latch 30 is electronically or mechanically configured to automatically engage upon closing the drawer 20. Thus, upon closing the drawer 20 the handgun safe 10 is locked shut and the drawer 20 cannot be opened by pulling on the drawer knob or otherwise applying reasonable force to the furniture.

At this point in time the gun is safely stored and completely concealed from intruders, children and other unauthorized users.

The handgun safe 10 may be opened in an emergency or otherwise by activating the switch 36 which causes the latch 30 to disengage. Additional security will be realized if the switch merely sends a command to a logic circuit or microprocessor associated with the handgun safe 10 which in circuit authenticates the user before actively causing the latch 30 to release. Authentication may be performed by biometric analysis, such as finger print identification or by known code or key methodologies. The switch 36 may be concealed behind the furniture 18 or otherwise to further assure that unauthorized persons do not realize that the drawer conceals a handgun safe. In such an embodiment only an authorized user can quickly access the contents of the handgun safe 10, even in the dark or in an emergency situation.

Alternatively, the bracket 23 or other attachment between the lid 14 and the article of furniture 18 may provide for a partial manual opening of the drawer for access to the supplemental lock 39. Thus, in embodiments where backup power is not supplied or the backup power and primary power supplies both fail, the gun owner could access the gun by pulling the drawer 20 out just enough to access the supplemental lock, unlocking the supplemental lock and then completing the opening procedure.

As described above the handgun safe 10 may optionally include means for causing the tray 12 to autonomously move horizontally into an open position with respect to the lid 14. For example, the handgun safe 10 may include one or more springs 40, or other mechanical or electromechanical device configured to automatically move the tray 12 and also the drawer 20 to an open position upon activation of the switch 36. If means to automatically open the handgun safe 10 are included in the system, the owner will be able to access his or her handgun nearly instantaneously in the case of an emergency by activating the switch 36 and reaching into the interior portion 16 of the tray 12 which has subsequently automatically opened.

Unless otherwise indicated, all numbers expressing quantities of ingredients, dimensions reaction conditions and so forth used in the specification and claims are to be understood as being modified in all instances by the term "about".

In this application and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

The embodiments have been particularly shown and described with reference to a number of specific examples. It would be understood by those skilled in the art that changes in the form and details may be made to the various embodiments disclosed herein without departing from the spirit and scope of the disclosure and that the various embodiments disclosed herein are not intended to act as limitations on the scope of the claims. All references cited herein are incorporated in their entirety by reference.

What is claimed is:

1. A handgun safe system comprising:

a tray configured to receive a handgun;

a lid operatively associated with the tray such that the tray may slide horizontally with respect to the lid thereby selectively revealing or concealing an interior portion of the tray; and an article of furniture comprising a frame and a drawer which may slide horizontally with respect to the frame; wherein the lid is attached to the frame and the tray is fixedly fastened to and positioned within the drawer and wherein a height of the lid is less than a gap between a back plate of the drawer and the frame; a latch associated with the lid and tray configured to secure the tray in a closed position with respect to the lid.

2. The handgun safe system of claim 1 wherein the latch is a dynamically adjustable latch configured to secure the tray in more than one selectable horizontal closed position with respect to the lid.

3. The handgun safe system of claim 1 further comprising an electronic switch configured to send a command to the latch causing the latch to disengage.

4. The handgun safe system of claim 3 wherein the electronic switch comprises a biometric scanner.

5. The handgun safe system of claim 1 further comprising means for automatically moving the tray horizontally with respect to the lid upon disengagement of the latch.

6. The handgun safe system of claim 5 wherein the means for automatically moving the tray horizontally comprises at least one spring.

7. The handgun safe system of claim 3 further comprising a logic circuit in electronic communication with the latch and switch.

8. The handgun safe system of claim 7 further comprising a rechargeable battery in electronic communication with the logic circuit, latch and switch.

9. The handgun safe system of claim 1 further comprising a spacer attached to both the lid and the frame.

10. A method of operating a handgun safe comprising:

providing a handgun safe system comprising:

a tray configured to receive a handgun;

a lid operatively associated with the tray such that the tray may slide horizontally with respect to the lid thereby selectively revealing or concealing an interior portion of the tray; and an article of furniture comprising a frame and a drawer which may slide horizontally with respect to the frame; wherein the lid is attached to the frame and the tray fixedly fastened to and is positioned within the drawer and wherein a height of the lid is less than a gap between a back plate of the drawer and the frame;

latching the tray in a horizontal closed position with respect to the lid wherein the lid substantially covers the tray;

releasing a latch between the tray and lid; and automatically moving the tray horizontally with respect to the lid whereby the tray abuts a portion of the drawer and causes the drawer to move horizontally with respect to the frame.

* * * * *